United States Patent [19]

Bottelsen

[11] Patent Number: 4,886,280

[45] Date of Patent: Dec. 12, 1989

[54] DART WITH FLIGHT LOCK

[76] Inventor: Walter E. Bottelsen, 309 Felicia Dr., Santa Maria, Calif. 93455

[21] Appl. No.: 144,325

[22] Filed: Jan. 15, 1988

Related U.S. Application Data

[63] Continuation-in-part of Ser. No. 8,842, Jan. 30, 1987, Pat. No. 4,775,158.

[51] Int. Cl.[4] ..... A63B 65/02

[52] U.S. Cl. ..... 273/423; 403/354

[58] Field of Search ..... 273/419–423, 273/416; 411/143, 520; 446/61–63, 111; 403/296, 354

[56] References Cited

U.S. PATENT DOCUMENTS

| | | | |
|---|---|---|---|
| 219,881 | 9/1879 | Streeter | 273/423 X |
| 499,312 | 6/1893 | Turner | 411/520 X |
| 1,190,343 | 7/1916 | Tyrrell | 446/62 |
| 1,907,960 | 5/1933 | Guillet | 403/296 |
| 1,970,525 | 8/1934 | Lyons | 411/143 X |
| 2,221,141 | 11/1940 | Kindt | 403/296 X |
| 2,289,284 | 7/1942 | Chandler | 273/422 |
| 2,794,622 | 6/1957 | Phillips | 403/296 |
| 2,873,973 | 2/1959 | Hauch | 273/421 |
| 3,022,966 | 2/1962 | Briggs | 446/61 X |
| 3,126,880 | 3/1964 | Loe | 446/63 X |
| 4,006,901 | 2/1977 | Simo | 273/422 |
| 4,457,514 | 7/1983 | Paxman | 273/420 |

FOREIGN PATENT DOCUMENTS

| | | | |
|---|---|---|---|
| 67225 | 1/1951 | Netherlands | 446/111 |
| 1524324 | 9/1978 | United Kingdom | 273/423 |
| 2085740 | 5/1982 | United Kingdom | 273/416 |
| 2097685 | 11/1982 | United Kingdom | 273/416 |

*Primary Examiner*—Paul E. Shapiro

*Attorney, Agent, or Firm*—Christie, Parker & Hale

[57] ABSTRACT

A dart comprises a shaft having a flight lock for securely mounting a flight on the shaft. The flight lock comprises a threaded post extending rearwardly from the shaft body and a flight holder mounted on the post. The flight holder has a threaded axial bore at its front end for receiving the post and an X-shaped slot at its rearward end which extends forwardly to a position overlapping the bore. A flight is inserted into the slit and is pushed forwardly until it enters the back of the bore. The flight holder is then threaded onto the post until the post engages the flight and wedges it between the post and the wall of the flight holder defining the bore. In another embodiment of the invention, the flight lock comprises an x-shaped slit extending forwardly from the rearward end of the shaft. A locking hole extends transversely through the shaft at a position rearward of the forward end of the slit. A tapered wooden locking pin is inserted into the locking hole and through a flight lying within the slit to lock the flight in the shaft.

2 Claims, 4 Drawing Sheets

67
62
71
61
66
64
63
68
71

DART WITH FLIGHT LOCK

This is a continuation-in-part of application Ser. No. 008,842, filed Jan. 30, 1987, now U.S. Pat. No. 4,775,158.

FIELD OF THE INVENTION

This invention relates to darts in general and more particularly to a dart having a flight lock for securely attaching the flight to the dart shaft.

BACKGROUND OF THE INVENTION

Conventional darts are comprised of a barrel, typically made of brass or other metal, a metal point attached to the front end of the barrel, a shaft which can be made of plastic or metal connected to the rearward end of the barrel and a flight mounted at the rearward end of the shaft. The flight is typically made of plastic or reinforced fabric.

The rearward end of the shaft is typically divided into four prongs by an X-shaped slot. The flight is mounted on the shaft by inserting the forward end of the flight into the slot. Such an arrangement has certain drawbacks. If the slot is wide enough to easily insert the flight, the flight can be easily pulled out of the slot. Thus, players must take care not to remove the dart from a dart board or even pick up the dart by the flight. Even with care, inadvertent removal of the flight is a problem.

Narrowing the slot reduces the problem of inadvertent flight removal but makes it difficult to insert the flight into the slot. This is often aggravated if the forward tip of the flight becomes frayed as a result of unsuccessful attempts to insert the flight into the slot. In such situations, players often use a tool such as the tip of another dart to spread apart the prongs of the shaft and widen the slot. This may result in permanent spreading of the prongs or other damage to the shaft or damage to the tip of the dart used to spread the prongs.

SUMMARY OF THE INVENTION

The present invention provides a dart comprising a shaft having a flight lock which essentially eliminates inadvertent flight removal, yet provides a means for easily and rapidly mounting the flight on the shaft. The dart comprises a barrel, a tip assembly extending forwardly from the barrel, a shaft extending rearwardly from the barrel and a flight mounted at the rearward end of the barrel.

The shaft comprises an elongated body with means at the forward end of the body for securing the shaft to the rearward end of a dart barrel. The rearward end of the shaft comprises a flight lock for releasably securing a flight to the shaft. The flight lock comprises a threaded post which extends rearwardly from and coaxial with the shaft body and a flight holder which is mounted on the post.

The flight holder is generally cylindrical and comprises a threaded, axial bore extending at its forward end for receiving the threaded post. An X-shaped slit extends generally axially and forwardly from the rearward end of the flight holder to a position overlapping the bore. The X-shaped slit divides the rearward portion of the flight holder into four prongs. In a preferred embodiment of the invention, the flight holder comprises an axial, conical indentation in its rearward end. The indentation serves as a guide for inserting the flight.

In such an embodiment, to securely mount the flight on the shaft, the forward end of the flight is inserted into the indentation in the back of the flight holder, the four wings of the flight being aligned with the four arms of the slot. The flight is then pushed into, and all the way to the front of, the slot. In this arrangement, the forward end of the flight extends into the rearward end of the bore. The flight holder is then screwed onto the threaded post to a position wherein the forward end of the flight is contacted by the post and is wedged between the post and the wall of the flight holder which defines the bore.

In another preferred embodiment of the invention, the rearward end of the axial bore is tapered or conical and the length of the post is greater than the depth of the bore. In such an embodiment, it is preferred that the rearward end of the flight holder be pointed, rather than indented.

In this embodiment, to mount the flight on the shaft, the flight holder is first threaded onto the post until the rearward end of the post engages the tapered rearward end of the bore. The flight holder is further rotated onto the post which causes the prongs of the flight holder to spread apart thereby widening the X-shaped slit into which the flight is inserted. The flight holder is then backed off of the post, i.e., rotated in the opposite direction, to a position wherein the prongs clamp down on the flight. In such an arrangement, the flight holder grips the flight tightly, eliminating any gap between the prongs and the flight. This prevents an inadvertent removal of the flight.

To further secure the flight to the shaft, the flight holder is rotated, i.e., unscrewed, until the rearward end of the post is at a position forward of the slit. The flight is then pushed forwardly until it engages the forward end of the slit. The flight holder is then rotated back onto the post to a point wherein the forward end of the flight is contacted by the post and is wedged between the post and the wall of the flight holder which defines the bore.

In another preferred embodiment of the invention, the flight lock comprises a forwardly extending x-shaped slit at the rearward end of the shaft for receiving the forward end of a flight. A locking hole extends transversely through the shaft at a position rearward of the forward end of the slit. In such an arrangement, a flight may be inserted into the slit to a position intersecting and blocking the hole. A locking pin may then be inserted into the locking hole and through the flight to lock the flight in place and thereby prevent its inadvertent removal of the flight.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
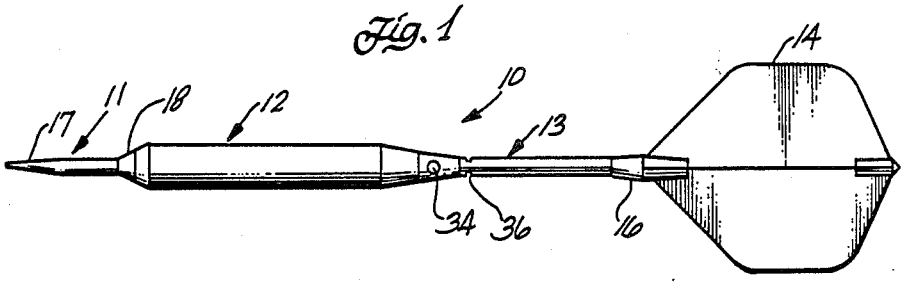
FIG. 1 is a side view of a preferred dart made in accordance with the present invention.
Figure 2:
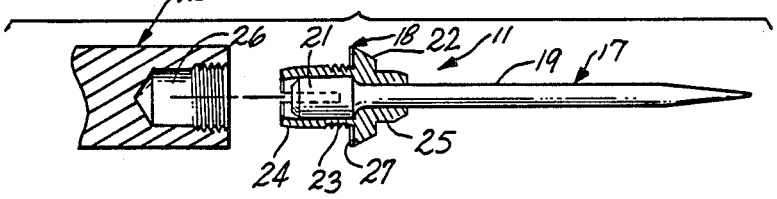
FIG. 2 is an enlarged exploded cross-sectional view of the tip assembly and the forward end of the barrel.
Figure 3:
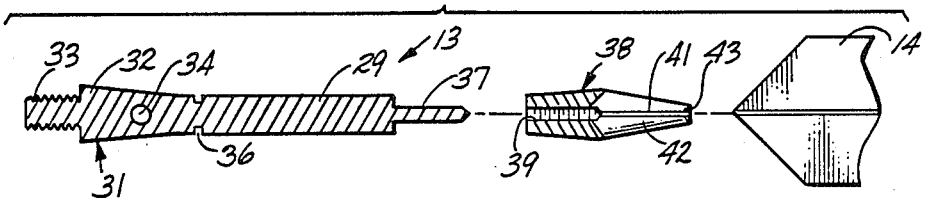
FIG. 3 is an enlarged exploded cross-sectional view of the shaft and flight.

A particularly preferred dart made in accordance with the present invention is shown in FIGS. 1–3. The dart 10 comprises a tip assembly 11 which is mounted on the front end of a barrel 12. A shaft 13 extends rearwardly from the barrel 12. At the rearward end of the shaft 13, a flight 14 is attached to the shaft 13 by a flight lock 16. In the embodiment shown, the tip assembly 11 comprises a retractable point 17 mounted in a clip 18, for example, as described in U.S. Pat. No. 4,230,322, which is incorporated herein by reference. The point 17 consists of an elongated rod-like body 19 having a sharp forward end and an enlarged, generally cylindrical head 21 at its rearward end. The clip 18 is annular and has a generally conical flange 22 at its forward end, a threaded, generally cylindrical middle section 23 and rearward section comprising four rearwardly extending spring fingers 24. The four fingers 24 are biased radially inwardly.

The inner diameter of the flange 22 and middle section 23 is about the same as the outer diameter of the body 19 of the point 17 and less than the outer diameter of the enlarged head 21 of the point 17. The point 17 is mounted in the clip 18 with the body 19 of the point 17 extending through the middle section 23 and the flange 22 of the clip 18. The enlarged head 21 of the point 17 is captured by the fingers 21 of the clip 18.

The barrel 12 comprises a threaded axial bore 26 at its front end. The depth of the bore 26 is about the same as or slightly greater than the distance from the flange 22 of the clip 18 to the rearward end of the fingers 24. The tip assembly 11 is mounted on the front end of the barrel 12 by threading the clip 18 into the bore 26 until the rearward face of the flange 22 engages the front face of the barrel 12.

To tighten the clip 18 against the barrel 12, the flange 22 has a pair of opposing notches 25 which allow the clip to be gripped and rotated by pliers or the like. To avoid inadvertent rotation of the clip 18 after assembly resulting in a loosing of the clip 18 from the barrel 12, the flange 22 of the clip 18 is provided with a pair of small projections 27 which extend rearwardly from the rearward face of the flange 22. When the clip 22 is threaded into the bore 26 of the barrel 12, the projections 27 contact the front face of the barrel 12 first. Further rotation of the clip 18 into the barrel 12 causes the projections 27 to generate a spring force or preload against the barrel 12 and flange 22 generally similar to the force created by a lock washer, thus preventing inadvertent rotation and unscrewing of the clip 22.

Preferred projections 22 are made by crimping the edges of the flange 22, for example with wire cutters, pliers or the like, to cause the formation of a pair of notches and a corresponding pair of projections which extend rearwardly along the periphery of the flange 22.

It is apparent that projections 27 formed by any suitable method may be used. The number, size, shape and location of the projections is not critical, provided that the projections are not so large or numerous to prevent the rear face of the flange from being tightened down against the front face of the barrel.

With reference to FIG. 3, the shaft 13 comprises an elongated rod-like body 29. At the front or head end of the shaft 13 there is a male coupling 31. In the embodiment shown, the male coupling 31 has a generally conical body 32 and a forwardly extending externally threaded cylindrical boss 33 which can be screwed into a corresponding threaded axial bore (not shown) in the rearward end of the barrel 12.

A lock down hole 34 extends through the body 32 of the male coupling 31. A rod or the like can be inserted through the lock down hole 34 for tightening the male coupling 31 and hence the head of the shaft 13 against the rear end of the barrel 12.

In the embodiment shown, the shaft 13 comprises a circumferential slot 35. The circumferential slot 35 is an intentionally weakened area so that, in the event that a force is exerted on the shaft causing it to bend or break, it will bend or break at the slot 35. This is desirable because it eliminates breakage of the shaft 13 in the back of the barrel 12 at a point where it cannot be removed without specialized tooling. Moreover, if bending occurs at the slot, the shaft can often be bent back to straight. This is unlike a conventional dart shaft which, once bent, is very difficult, if not impossible, to straighten.

The flight lock 16 comprises a threaded post 37 which extends rearwardly from the body 29 of the shaft 13 and a flight holder 38 which is mounted on the post 37. The flight holder 38 is generally cylindrical and comprises a threaded axial bore 39 at its front end. In the embodiment shown, the bore 39 has a diameter about the same as the diameter of the post 37 and has a depth at least as great as the length of the post 37.

The flight holder 38 further comprises an axial X-shaped slit 41 which extends forwardly from the back of the flight holder 38 to a point forward of the rearward end of the bore 39. That is, the slit 41 in the bore 39 overlap. The width of the slit 41 is preferably about the same as the thickness of the wings of the flight 14. The slit 41 divides rearward portion of the flight holder 38 into four generally equal quadrants, each quadrant forming a prong 42.

The rearward end of the flight holder 38 has a generally conical indentation 43. The indentation 43 serves as a guide for mounting the flight in the flight holder 38. To avoid, or at least minimize, damage to the flight 14 and the flight holder 38 caused by subsequently thrown darts, a metal deflector 44 is preferably mounted on the rearward end of the flight 14.

Figure 4:
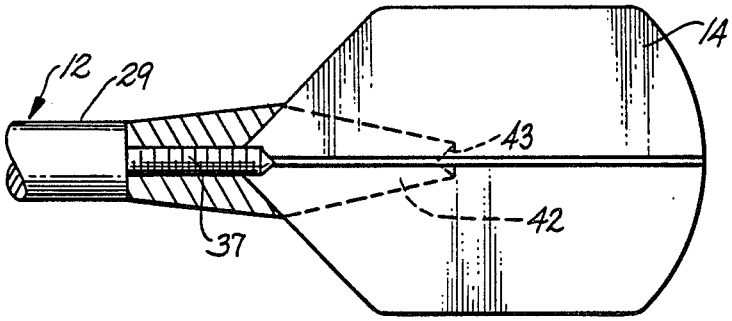
FIG 4 is a cross sectional view showing the flight mounted in the flight lock.

The flight 14 is mounted in the flight holder 38 by inserting the forward tip of the flight 14 into the conical indentation 43 in the back of the flight holder 38 and aligning the four wings of the flight 14 with the four arms of the X-shaped slit 41. The flight 14 is then pressed forwardly into the slit 41 until the front end of the flight 14 engages the forward end of the slit 41. Thus, the front end of the flight 14 extends into the back of the bore 39, as shown in FIG. 4. The flight holder 38 is then threaded onto the post 37.

Because the slit 41 and the bore 39 overlap, the rearward end of the post 37 engages the front end of the flight 14 and wedges it between the post 37 and the wall of the flight holder 16 defining the bore 39. This firmly grips and holds the flight 14, securing it to the shaft 13.

Figure 5:
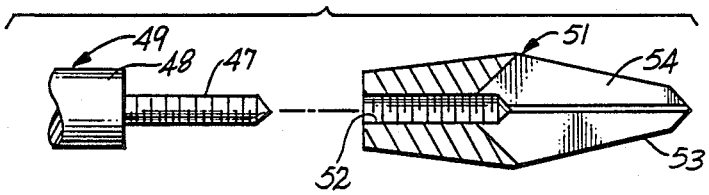
FIG. 5 is an exploded cross-sectional view of another preferred flight lock.
Figure 6:
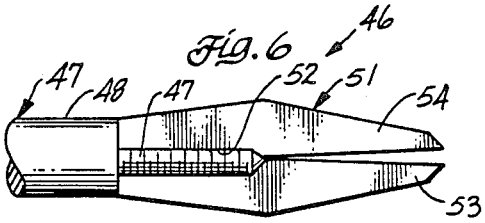
FIG. 6 is a cross-sectional view of the flight lock of FIG. 5 showing the pinchers spread-apart.

With reference to FIGS. 5 and 6, there is shown another preferred flight lock 46. Again, the flight lock 46 comprises a threaded post 47 which extends rearwardly and coaxially from the body 48 of the dart shaft 49 and a flight holder 51 mounted on the post 47. The flight holder 51 has a threaded axial bore 52 extending rearwardly from its forward end. The rearward end of the bore 52 is tapered or conical. In this embodiment, the length of the post 47 is greater than the depth of the bore 52.

The flight holder 51 further comprises an X-shaped slit 53 dividing the rearward portion of the flight holder 51 into four pinchers or prongs 54. The X-shaped slit 53 again extends from the back of the flight holder 51 forwardly to a position in front of the rearward end of the bore 52. Thus, the X-shaped slit 53 and the bore 52 overlap. The thickness of the slit is preferably less than the thickness of the wing of the flight (not shown). In this embodiment, the rearward end of the flight holder 51 is pointed, i.e., tapers rearwardly and radially inwardly.

To mount a flight on the shaft 49, the flight holder 51 is first threaded onto the post 47 to a point wherein the rearward end of the post 47 contacts the rearward end of the bore 52. Further rotation of the flight holder 52 onto the post 47 causes the pinchers 54 of the flight holder 51 to spread apart, i.e., to spread radially outwardly. Accordingly, the flight holder 51 is threaded onto the post 47 until the pinchers 54 are spread apart sufficiently to enable the forward end of the flight to be inserted into the slit 53. Once this is accomplished, the flight holder 51 is backed off or unscrewed from the post to a position wherein the post 47 no longer contacts the back of the bore 52. At this position the pinchers 54 close down onto and grip the flight to hold it in place.

If a tighter grip is desired, the flight holder 51 is further unscrewed to a position wherein the rearward end of the post 47 is in front of the forward end of the slit 53. The flight is then manually pushed forward until the front end of the flight engages the forward end of the slit 53, and hence extends into rearward end of the bore 52. The flight holder 51 is then threaded back onto the post until the post engages the flight, and wedges it between the post 47 and the wall of the flight holder 51 defining the bore 52.

The flight lock of the present invention offers several unique advantages over conventional dart shaft designs. Foremost is the ability of the flight lock to grip and lock the flight to the shaft. Such a grip is typically tightened to enable a player to pick up the darts by the flight or even remove the darts from the board by pulling on the flight without worry. Thus, the present design eliminates inadvertent flight removal.

The second embodiment described above offers another advantage by virtue of the pointed rearward end of the flight holder. Such a design obviates the need for a deflector at the back of the flight by eliminating or at least severely reducing the occurrence of "Robinhoods." "Robinhood" is the term used to describe the situation wherein a dart is thrown into the back of a previously thrown dart, the point of the second dart entering the gap between the prongs of the shaft and the flight of the first dart. Because the prongs or pinchers of the present invention firmly grip the flight, there is no gap between the flight and the prongs. Because the prongs are tapered to a point, subsequently thrown darts are deflected by the flight holder.

Figure 7:
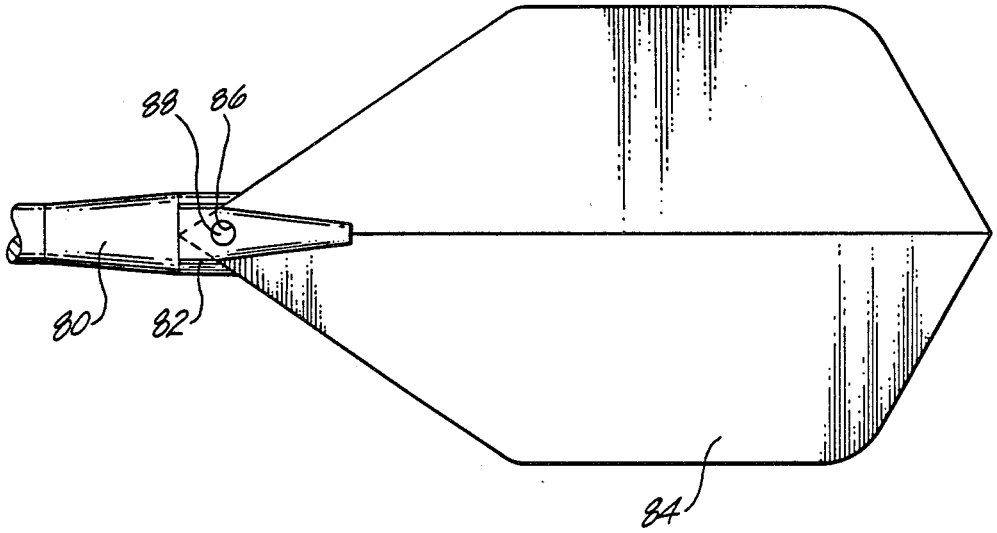
FIG. 7 is a side view of another preferred flight lock in accordance, with the present invention.
Figure 8:
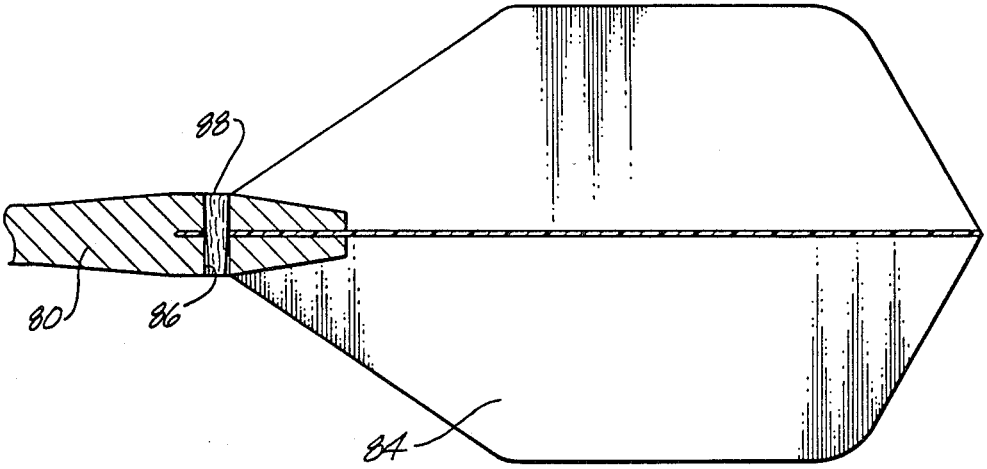
FIG. 8 is a side cross-sectional view of the flight lock of FIG. 7.

With reference to FIGS. 7 and 8, there shown an alternate embodiment of the invention in which the dart shaft comprises another preferred flight lock. In this embodiment, the dart shaft 80 has a rearward end comprising a generally x-shaped slit 82 for receiving the forward end of a flight 84. The shaft 80 further comprises a locking hole 86 which extends transversely through the shaft 80 at a position rearward of the forward end of the slit 82. The locking hole 86 is at a location wherein the flight, when positioned within the slit 82, intersects and blocks the locking hole 86.

The flight lock further comprises a locking pin 88 which is inserted into the locking hole 86 and through the flight 84, thus locking the flight 84 in the slit 82. The diameter of the locking pin 88 is selected so that it fits snugly within the hole 86 and is not easily jarred loose. The punctured edges of the flight generally aid in holding the pin 88 in place within the hole 86.

The pin 88 may be cylindrical or, more preferably, comprises slight taper. Preferably, the end of the pin 88 which is initially introduced into the hole 86 is pointed to facilitate puncturing of the flight 84. If the pin 88 is not pointed, it may be necessary to puncture a hole in the flight, for example with the point of another dart, before inserting the pin 88. The length of the pin 88 is not critical, but is preferably selected so that the ends of the pin 88 lie within the locking hole 86 or are flush with the outer surface of the shaft 80.

The pin 88 may be made of any suitable material including metal, plastic, or wood. For example, segments of wood, metal, or plastic doweling cut to the desired length may be used. In one embodiment of the invention, the locking hole is slightly smaller than the maximum diameter of a conventional cylindrical toothpick and the pin is formed from such a toothpick. In such an embodiment, one end of the toothpick is inserted into the locking hole 86 and punctures the flight 84 which lies within the slit 82 of the shaft 80. The toothpick is passed through the locking hole 86 until it is wedged tightly within the hole 86. The ends of the toothpick protruding from the locking hole 86 are then manually broken off.

To change a flight 84, the locking pin 88 is simply pushed out of the locking hole 86 by any convenient means. The removable point of the dart may be used for this purpose. The flight 84 and the shaft 80 is then removed and a new flight 84 inserted. The locking pin 88 is then reinserted into the locking 86 to lock the new flight in place.

The preceding description has been presented with reference to the preferred embodiments of the invention shown in the accompanying drawings. Workers skilled in the art to which this invention pertains will appreciate that alterations and modifications in the described structures can be made without departing from the scope and spirit of the invention.

For example, the darts described above included a tip assembly that screwed into the front of the barrel and had a retractable point. It is apparent that a tip or tip assembly comprising a stationary point may be used. It is also apparent that a tip or tip assembly that is press-fit into the barrel rather than screwed may be used. However, due to the ease of replacement, tips or tip assemblies which can be threaded into the barrel are preferred. With such tips or tip assemblies, it is also preferred that the tip or tip assembly have a flange which butts up against the front end of the barrel when assembled and that the flange have one or more small projections that extend rearwardly from the flange to prevent the tip assembly from unscrewing from the barrel.

In the embodiment described above, the body of the shaft comprises a circumferential slot to control the location of any bending or breaking of the shaft. It is apparent that shafts not having such intentionally weakened area may be used. It is also apparent that if a shaft with an intentionally weakened area is desired, any suitable shaft design may be used. For example, rather than a circumferential slot, an enlarged lock down hole may provide a sufficiently weakened point along the shaft to control the location of any bending or breakage.

Figure 9:
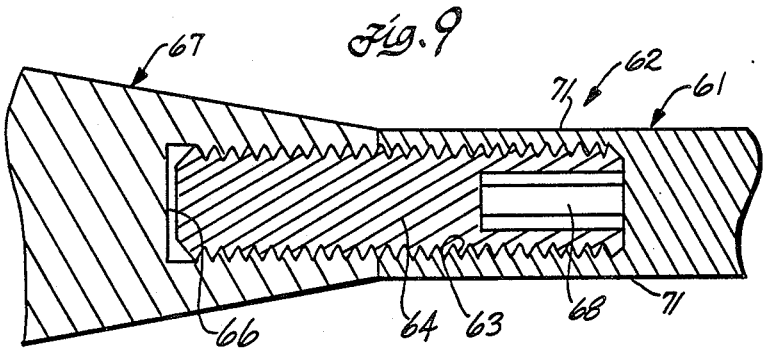
FIG. 9 is a cross-sectional view of another preferred embodiment showing a barrel and a shaft having an intentionally weakened area.

Another example of a shaft having a weakened area is shown in FIG. 9. In this embodiment, the body 61 of the dart shaft 62 is made of a stiff lightweight material such as aluminum or the like and comprises a threaded axial bore 63 at its forward end. Threaded into the axial bore 63 is a threaded metal stud 64 made of steel or the like. The forward end of the stud 64 extends out of the axial bore 63 and comprises threads so that it can be screwed into the threaded bore 66 at the rearward end of the barrel 67 to couple the shaft 62 to the barrel 67. The stud 64 comprises a hexagonally-shaped hole 68, i.e. a hole with a hexagonal transverse cross section, at its rearward end. The size of the hole is selected to fit an appropriately sized allen wrench.

In this embodiment, the weakened area of the shaft body 61, i.e. the spot where most, if not all, of any bending or breakage would occur, lies adjacent the rearward end of the axial bore 63 at reference numeral 71. The reason that this particular location would be the most susceptible to breakage is because of the reduced cross sectional area. That is, the portion of the shaft body 61 rearward of location 71 is solid and therefore less likely to bend or break. The portion of the shaft body forward of location 71 is supported by the steel stud and therefor less likely to bend or break.

If breakage at location 71 does occur exposing the rearward end of the stud 64, the stud 64 and the portion of the shaft body 61 surrounding the stud 64 can be easily removed by means of an allen wrench of an appropriate size for the hole 68 at the rearward end of the stud 64.

In the flight locks described above which include a threaded post at the back of the shaft and a flight holder mounted on the shaft, it is apparent that the diameter of the post may be less than, the same as, or even greater than, the diameter of the shaft body. Also, the specific shape of the flight holder may vary. For example, rather than having a circular transverse cross-section, it may have a square transverse cross-section.

Accordingly, the foregoing description should not be read as pertaining only to the precise structures described, but rather should be read consistent with and as support for the following claims which are to have their fullest fair scope.

What is claimed is:

1. A dart comprising:

a barrel;

a tip coaxially mounted at the forward end of the barrel;

a shaft extending rearwardly from the rearward end of the barrel comprising an elongated shaft body and a flight lock at the rearward end of the shaft body, said flight lock comprising:

a generally x-shaped slit extending forwardly from the rearward end of the shaft for receiving the forward end of a flight;

a locking hole extending transversely through the shaft at a position rearward of the forward end of a the slit for receiving a locking pin; and a wooden tapered locking pin removably inserted into the locking hole;

a flight mounted in the x-shaped slit such that the locking pin punctures and passes through the flight, thereby preventing inadvertent removal of the flight from the shaft.

2. A method for mounting a flight to the rearward end of a dart shaft comprising:

providing a dart shaft having a slit which extends forwardly from the rearward end of the shaft and a locking hole which extends transversely through the shaft at a position rearward of the forward end of the slit;

mounting a flight on the shaft by inserting the forward end of the flight into the slit;

inserting one end of a toothpick into the locking hole so that it punctures the flight and is securely wedged within the locking hole; and breaking off at least the major portion of the toothpick protruding from the locking hole.

* * * * *